US006853821B2

(12) United States Patent
Ishiguro et al.

(10) Patent No.: US 6,853,821 B2
(45) Date of Patent: Feb. 8, 2005

(54) IMAGE FORMING DEVICE AND TONER DEVICE

(75) Inventors: Yasuyuki Ishiguro, Higashiosaka (JP); Keiji Kato, Nara (JP); Toshio Nishino, Yamatokoriyama (JP); Atsushi Inoue, Nara (JP); Toshihide Ohgoshi, Nara (JP); Humito Mizoguchi, Nara (JP); Wataru Yoshida, Hirakata (JP)

(73) Assignee: Sharp Kabushiki Kaisha, Osaka (JP)

( * ) Notice: Subject to any disclaimer, the term of this patent is extended or adjusted under 35 U.S.C. 154(b) by 21 days.

(21) Appl. No.: 10/430,306

(22) Filed: May 7, 2003

(65) Prior Publication Data

US 2003/0219284 A1 Nov. 27, 2003

(30) Foreign Application Priority Data

May 27, 2002 (JP) ..... 2002-152372

(51) Int. Cl.[7] ..... G03G 15/08
(52) U.S. Cl. ..... 399/119; 399/262
(58) Field of Search ..... 399/119, 110, 399/262

(56) References Cited

U.S. PATENT DOCUMENTS 5,121,165 A * 6/1992 Yoshida et al. ..... 399/119
5,298,948 A * 3/1994 Kurisu ..... 399/119
5,835,822 A * 11/1998 Nagasaki et al. ..... 399/262
6,741,822 B2 * 5/2004 Ishiguro et al. ..... 399/119

FOREIGN PATENT DOCUMENTS

JP 9-230694 A 9/1997

* cited by examiner

*Primary Examiner*—Susan Lee
(74) *Attorney, Agent, or Firm*—Birch, Stewart, Kolasch & Birch, LLP

(57) ABSTRACT

A toner cartridge stored in a developer casing includes a biasing force generating device, an actuating rod that switches the biasing device between an active state and a non-active state by one movement of a release member. A developer casing swings by the movement of the actuating rod and presses a developing roller with appropriate pressure to a photosensitive drum. There is a lock member that is restrained from moving by the movement of the actuating rod. The structure recited is capable of inserting and fixing the developer casing to an image forming device. Also, by one restore movement of the release member, the photosensitive drum and the developing roller are separated and the lock is released, thereby enabling removal/exchange of the developer casing.

4 Claims, 11 Drawing Sheets

(a)

(b)

(a)

(b)

(a)

(b)

IMAGE FORMING DEVICE AND TONER DEVICE

FIELD OF THE INVENTION

The present invention relates to a toner cartridge mounted on an image forming device for forming an image on a recording medium using electrophotographic technology (such as a copier or a printer), and an image forming device comprising this toner cartridge.

DESCRIPTION OF THE RELATED ART

In a conventional image forming device such as a copier or a laser printer, an electrostatic latent image is first formed on a surface of a photosensitive drum, and then the image is developed by a developing device to create a toner image.

In general, the developing device comprises a developing device body for supplying toner to the electrostatic latent image on the photosensitive drum via a developing roller, and a toner casing for supplying the toner to the developing device body. The toner casing generally adopts an exchangeable cartridge system so that a user can easily exchange the toner casing equipped to the image forming device body when the toner is used up, the cartridge system enhancing the operability of the toner cartridge exchange and reducing the work of the user.

According to the cartridge system, the user can perform maintenance operation of the device without having to call for a service person, so the labor of the user is reduced. Therefore, image forming devices adopting this cartridge system is being used widely.

According to the developing device (image forming device) adopting the cartridge system, when the cartridge is inserted to and mounted on the mounting guide unit of the image forming body, the developing device is positioned and fixed to the appropriate position by the operation of a lever and the like. At this time, the developing roller is opposed to and pressed against the photosensitive drum. When the toner inside the cartridge is consumed and used up by image forming processes, the pressurized state of the developing roller against the photosensitive drum is released by an operation of the lever or the like, and the used toner cartridge is removed and exchanged with a new (not used) toner cartridge.

Japanese Patent Laid-Open No. 9-230694 discloses an electrophotographic image forming device capable of disposing a developer (developing roller) supported via a developer rotary to a process cartridge (photosensitive drum) in a stable pressurized manner.

According to the above-mentioned image forming device, the inner structure of the image forming device is complicated, equipped with operating members, link mechanism and the like to press the developing roller against the photosensitive drum. It is difficult to press the developing roller against the photosensitive drum with even pressure when using the pressurizing force provided by the operating members and the link mechanism. That is, since the above device adopts a structure supporting the relatively heavy developer unit from underneath with a stay so as to enable swinging movement of the developer unit, it is difficult to press the developer unit against the photosensitive drum with stable pressure.

In order to press the developing roller with even pressure to the photosensitive drum, the forces generated by springs must be constant. In other words, the spring lengths (amount of displacement or deformation) of the springs disposed at plural locations must be made as uniform as possible.

When a pressurizing member and a link mechanism are used in the image forming device, the spring length becomes extremely unstable due to the accumulated dispersion of the size accuracy of the members themselves, the accuracy of assembly, the deformation of members during operation and so on. Though the size varies according to the type of device being used, when a pressurizing spring is disposed to two locations on both substantial ends of the developer device, it becomes necessary to make the spring deformation quantity constant in a length span of approximately 300 mm.

SUMMARY OF THE INVENTION

The present invention aims at solving the problems of the prior art. The object of the invention is to provide a toner cartridge with a simple structure that enables easy exchange of the toner cartridge, provides uniform pressure between the photosensitive drum and the developing roller, and to thereby enhance the safety and reliability of the operation, and to provide an image forming device equipped with the toner cartridge.

In order to achieve the above object, the present invention provides a toner cartridge removably mounted on a developer casing storing a developing roller for developing an electrostatic latent image formed on a circumferential surface of a photosensitive drum by pressing against the photosensitive drum, the toner cartridge comprising: a biasing force generating means disposed at plural areas that press against a fixed portion of an image forming device in elastic manner; an actuating rod capable of switching the biasing force generating means between a released state and a non-active state; a lock member capable of pivoting along with the movement of the actuating rod and switching between maintaining and enabling release of a lock operation; and a manipulation member capable of sliding/pivoting motion causing predetermined movement of the actuating rod and the lock member, wherein the manipulation member, the actuating rod and the lock member are arranged so that they interconnect mutually; the sliding/pivoting motion of the manipulation member for moving the actuating rod causes movement of the lock member to realize or to release the lock operation, to thereby maintain or release a fixed state and simultaneously pivot or releasing pivot of the developer casing to the image forming device.

Moreover, the toner cartridge characterizes in that a single pivoting operation of the manipulation member realizes both the movement of the actuating rod switching the biasing force generating means provided to plural portions of the toner cartridge that press against said fixed portion of the image forming device body in elastic manner between a released state and a non-activated state and the movement for fixing the developer casing to and releasing the same from the image forming device body.

Furthermore, the toner cartridge is formed so that the biasing force generating means disposed at plural areas on the toner cartridge along the longitudinal direction are released in synchronism with the pivoting operation of the manipulation member, a reaction force of the biasing force generating means coming into contact with the fixed surface of the image forming device causing the developing roller of the developer casing to be pressed against the photosensitive drum.

Moreover, the present invention provides an image forming device comprising the toner cartridge mentioned above.

DETAILED DESCRIPTION OF THE PREFERRED EMBODIMENTS

Figure 2:
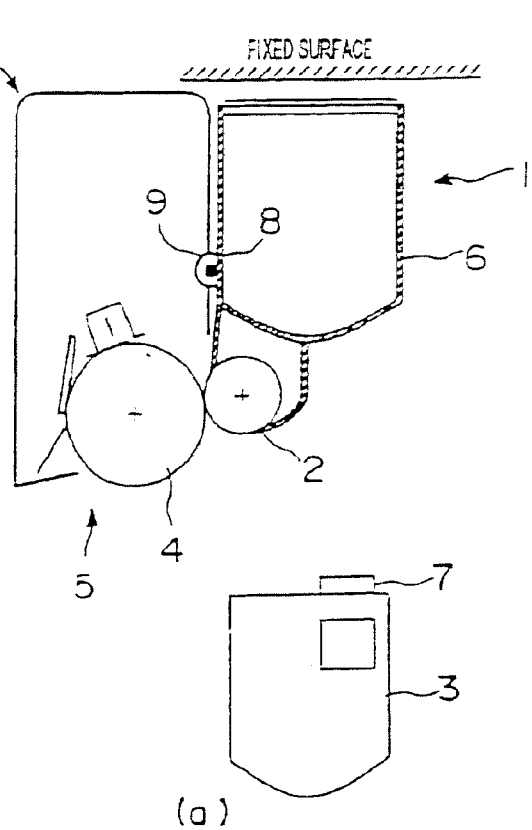
FIG. 2 PRIOR ART
FIG. 2 is a side view and a plan view showing the operation method of components constituting a prior art image forming device.
Figure 2:
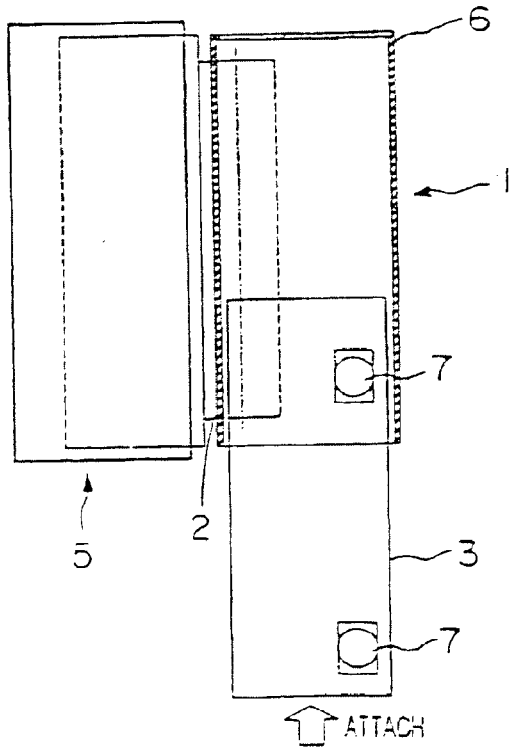
FIG. 2 PRIOR ART
Figure 3:
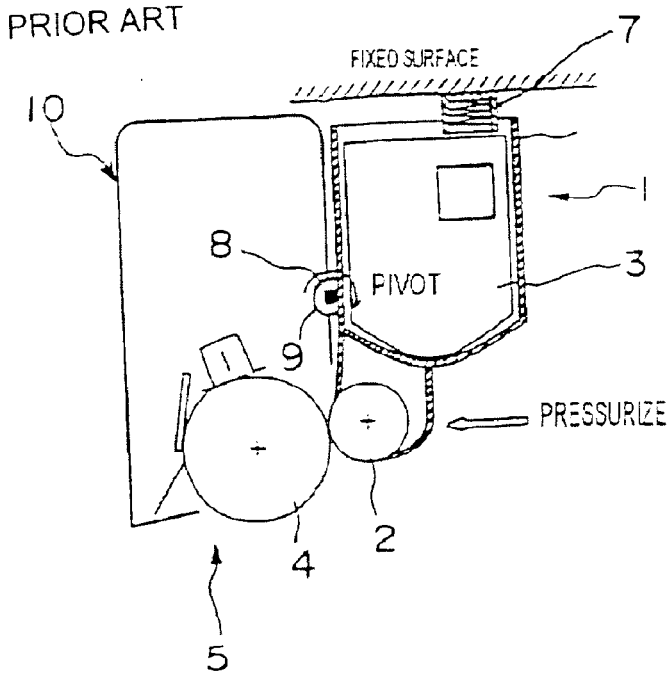
FIG. 3 PRIOR ART
FIG. 3 is a side view and a schematic plan view showing another operation method of the components constituting a prior art image forming device.
Figure 3:
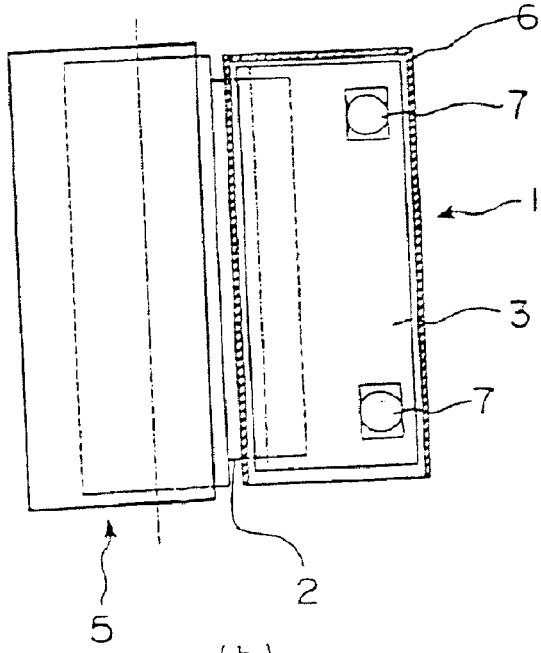
FIG. 3 PRIOR ART
Figure 4:
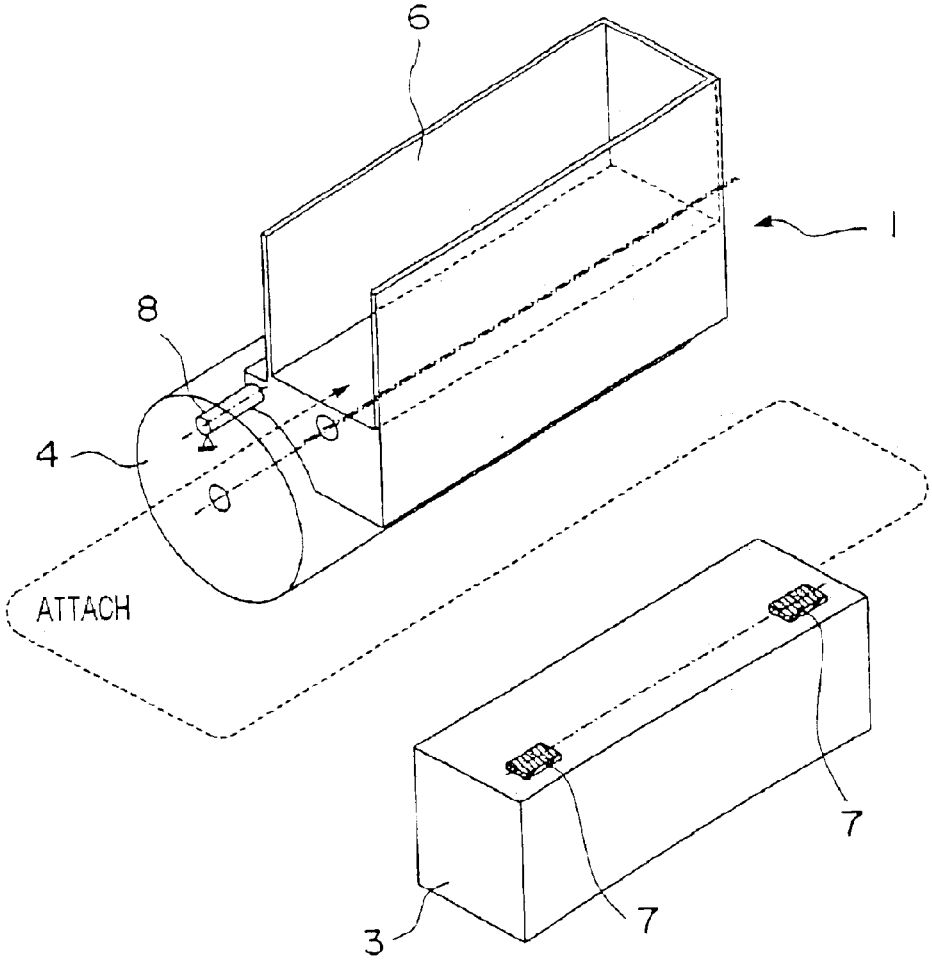
FIG. 4 is a perspective view showing the process of mounting a toner cartridge onto an attachment guide frame of a developer cartridge and removing the same therefrom.
Figure 5:
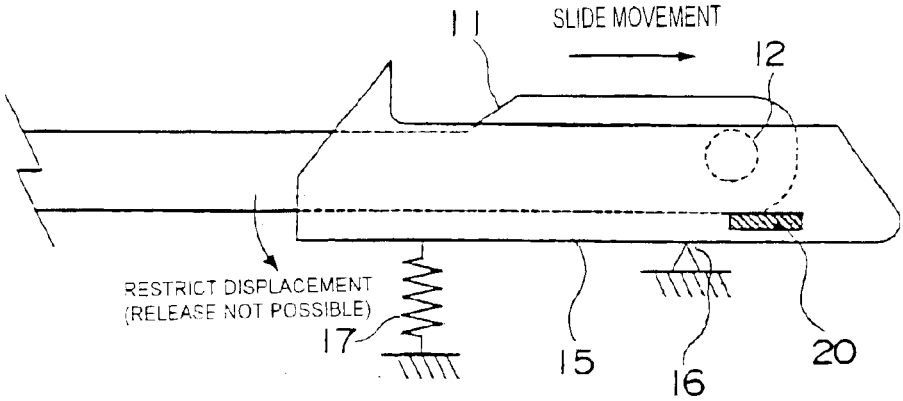
FIG. 5 is a view showing the positional relationship between a lock member and an actuating rod disposed on the top plate of the toner cartridge of the present invention.
Figure 5:
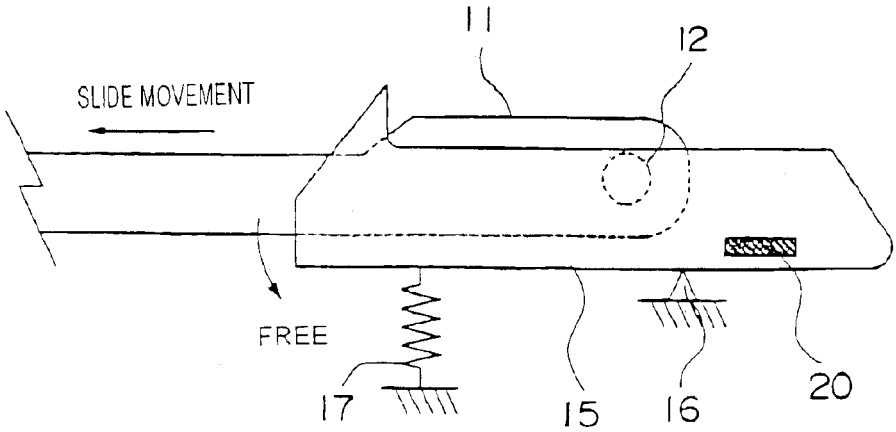

First, we will briefly explain the toner cartridge and the image forming device comprising the same according to a conventional art which constitutes the basis for the present invention (refer to FIGS. 2 to 4).

As illustrated in FIG. 2(*a*) and FIG. 3(*a*), the image forming device 10 comprises a developer casing 1 having an opened upper surface, an attachment guide frame 6 capable of removably supporting in its interior a toner cartridge 3, a lower side section adjacent to the bottom of the guide frame 6, and a developing roller 2 disposed within that section; and a process casing 5 having a photosensitive drum 4 disposed to oppose to the developing roller 2.

The image forming device 10 creates an electrostatic latent image on the surface of the photosensitive drum 4 stored in the process casing 5 based on an image data either obtained by scanning a document through an image reading unit or by receiving a data from an external device such as a PC terminal, and develops the latent image by a developing roller 2 to create a toner image, before transferring and developing the image on a transfer sheet.

The developer casing 1 comprising the developing roller 2 and the process casing 5 equipped with the photosensitive drum 4 are located in parallel relation with its side frame walls adjacent one another. The two casings are assembled together at the center of their side walls via a hinge structure attached integrally to each of the side walls and comprising a fulcrum axis 8 and an axis guide 9 having a C-shaped or U-shaped cross section and which can be detached from one another in the axial direction. The two casings are both capable of pivoting around the fulcrum axis 8.

In other words, the developer casing 1 is supported and positioned via the fulcrum axis 8 engaged to the axis guide 9 of the process casing 5 (mediated by the process casing 5) to the image forming device 10.

The axis guide 9 constituting one side of the hinge structure guides the fulcrum axis 8 of the developer casing 1 along the longitudinal direction when the developer casing 1 is inserted to or removed from the front side (in FIGS. 2(*a*) and 3(*a*)) of the image forming device 10. The axis guide 9 can be disposed integrally to the side wall of the process casing 5 as a guiding rail for positioning the developer casing with respect to the photosensitive drum 4.

Of course, the mounting structure of the fulcrum axis 8 and the axis guide 9 having a C- or U-shaped cross section can be disposed oppositely to the process casing 5 and the developer casing 1, respectively.

Figure 10:
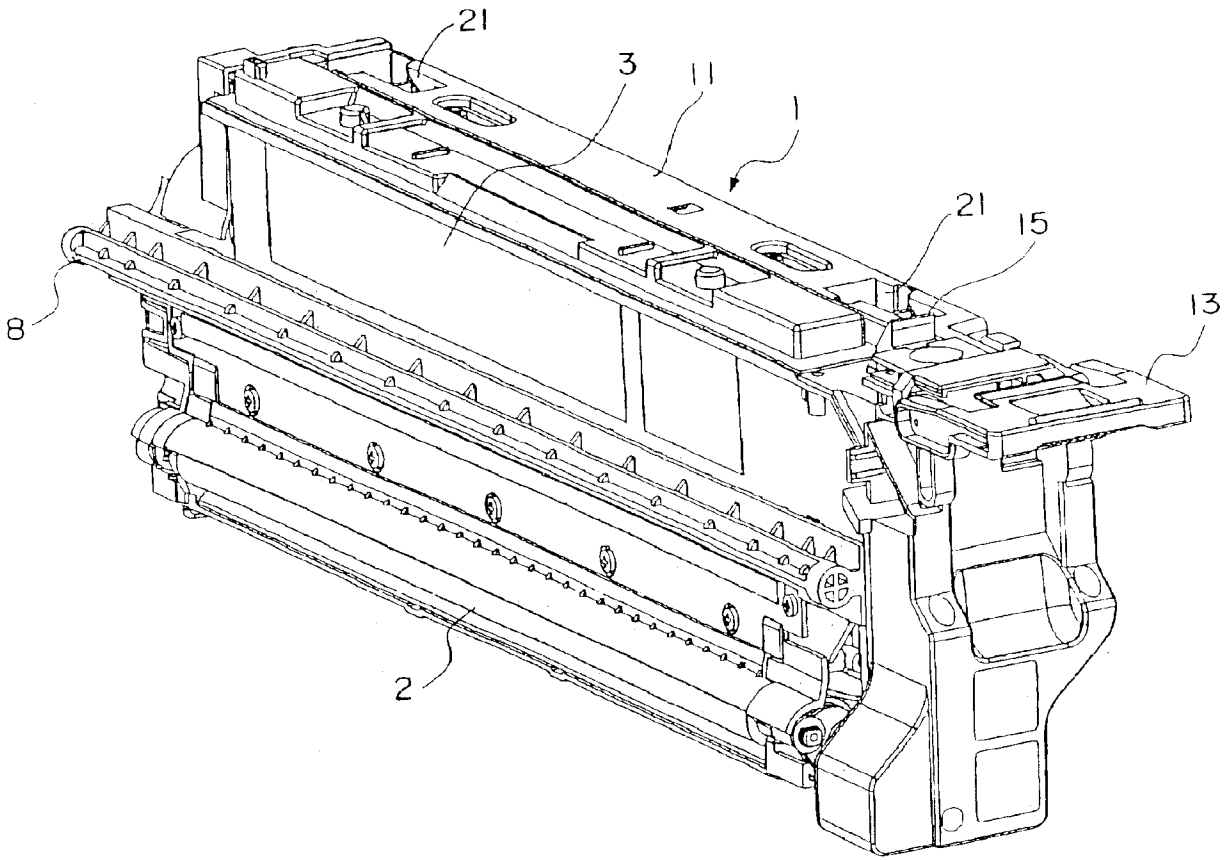
FIG. 10 is a perspective view showing the actual example of the developer casing having inserted thereto the toner cartridge according to the invention.

The configuration of the fulcrum axis 8 on the developer casing 1 that slides along the axis guide 9 can be extended throughout the longitudinal length of the casing, but the same effect can be achieved by disposing the configuration of axis 8 at least on the both end regions of the developer casing 1 (the actual example is illustrated in FIG. 10).

The axis of the developing roller 2, the photosensitive drum 4, the fulcrum axis 8 and the axis guide 9 are mutually disposed in parallel, and when the developing casing 1 and the process casing 5 attached via the fulcrum axis 8 and guide 9 pivot mutually, the generatrix of the developing roller 2 and the generatrix of the photosensitive drum 4 come into contact with or are separated from each other.

Since the center of gravity of the developer casing 1 is positioned opposite from the photosensitive drum 4 with regard to the fulcrum axis 8, the casing 1 moves (pivots) about the axis 8 in the clockwise direction by its own weight when attached to the process casing 5, and the developing roller 2 comes into light contact with the photosensitive drum 4. However, they are merely coming into slight contact with one another, and not ready (pressurized properly) for actual operation of the image forming device 10.

This image forming device 10 provides appropriate pressurizing force to the developing roller 2 against the photosensitive drum 4 and moves the developer casing 1 to the appropriate position for forming images when mounting and fixing the developer casing 1 to the image forming device 10.

As illustrated in FIG. 4, the developer casing 1 is equipped with an attachment guide frame 6 for storing the toner cartridge 3, and when exchanging the toner cartridge 3, the cartridge 3 is removed/inserted from the longitudinal end side of the developer casing 1 (refer to FIG. 2(*b*)) along the longitudinal direction of the attachment guide frame 6.

The toner cartridge 3 is a molded plastic product with a relatively strong housing (with an almost closed cross-sectional structure), and so the cartridge itself has sufficient strength and rigidity.

A plurality of biasing force generating means 7 are disposed along the longitudinal direction on the top plate surface of the cartridge 3 casing.

Upon mounting the toner cartridge 3 on the attachment guide frame 6 of the developer casing 1, the biasing force generating means 7 is made to come into contact with the fixed surface of the image forming device body 10 (such as a bottom surface of a base plate or a stay provided to connect the front side frame and the back side frame of the device) via the upper released portion of the guide frame 6 (refer to FIG. 3(*a*)), and utilizing the spring reaction force of a coil spring disposed in the biasing force generating means 7, the developer casing 1 is rotated (pivoted) around the fulcrum axis 8 in the clockwise direction. Thereby, the developing roller 2 equipped to the developer casing 1 is pressed with even force onto the photosensitive drum 4, and the exchangeability of the cartridge is thereby enhanced.

According to the above construction, by installing the toner cartridge 3 in the attachment guide frame 6 of the developer casing 1, the coil spring enables to provide pressurizing force for pressing the developing roller 2 evenly to the photosensitive drum 4, so a support/guide plate provided to a developer casing, a member for providing pressurizing force to the developer casing, and a link mechanism etc. that were provided to the prior art image forming device are no longer required, and the inner structure of the device can be simplified greatly.

Moreover, since the developing roller 2 is pressed against the photosensitive drum 4 by the elastic force of coil springs, the roller can be pressurized efficiently and evenly throughout the whole region coming into contact with the drum 4, enabling the roller 2 and drum 4 to be pressed together securely with very little dispersion of pressurizing force.

Thus, stable image forming is made possible.

The toner cartridge and the image forming device comprising the same according to the present invention and explained in detail below basically belongs to the art group explained above.

As for the handling of each unit constituting the above image forming device, there are considered two methods or examples for handling the same.

(a) According to the method or embodiment illustrated in FIG. 2, the toner cartridge 3 is handled as "SRU" (serviceperson replaceable unit) where the cartridge is replaced by the serviceperson.

In this case, the exchanging/mounting of the toner cartridge 3 is performed to the attachment guide frame 6 of the developer casing 1 assembled to the image forming device 10 in advance (refer to FIGS. 2 and 4).

(b) According to the method or embodiment illustrated in FIG. 3, the toner cartridge 3 is assembled to the attachment guide frame 6 of the developer casing 1 in advance when the unit is being manufactured, and the cartridge is fixed or attached in integral manner to the frame with an engaging means such as a screw.

The developer casing 1 and the toner cartridge 3 are handled as "CRU" (customer replaceable unit) where the cartridge and toner can be replaced as a set by the user when exchanging consumables.

When replacing, the pressurized state of the developing roller 2 and the photosensitive drum 4 is released at first, before the developer casing 1 is pulled out from (or mounted to) the image forming device along the longitudinal direction of the fulcrum axis 8 and guide 9.

The following description mainly relates to the case where the unit corresponds to "CRU" (though it does not necessarily eliminate the possibility of "SRU").

Next, one preferred embodiment of the toner cartridge and the image forming device comprising the same according to the present invention will be explained with reference to the drawings.

FIGS. 1 through 6 illustrate one embodiment of the toner cartridge and the image forming device comprising the same in perspective and cross-sectional views of the components and in mutually assembled states. Figures are referred to during the explanation.

At first, we will explain in detail a toner cartridge 3 to be equipped to an image forming device 10 of the present invention as a main member, an actuating rod 11, a release lever 13 and a lock member 15, with reference to FIGS. 1 through 5.

On one longitudinal end of the top plate of the toner cartridge 3 are integrally disposed the following: a pair of mutually opposed L-shaped guide grooves 14 (refer also to the perspective view of FIG. 9); a support axis (support unit) 16 for pivotably supporting a lock member 15 mentioned later; and a support spring (coil spring) 17 for biasing the lock member 15 to the locking direction.

Similarly, the following members are integrally disposed thereto: guides with sliding surfaces formed along the left and right inner side walls of the actuating rod so as to guide the actuating rod 11 that slides along with the pivoting motion of a release lever (manipulation member) 13; and mounting seats (at plural areas) for mounting the biasing force generating means 7 having a coil spring installed thereto.

Figure 9:
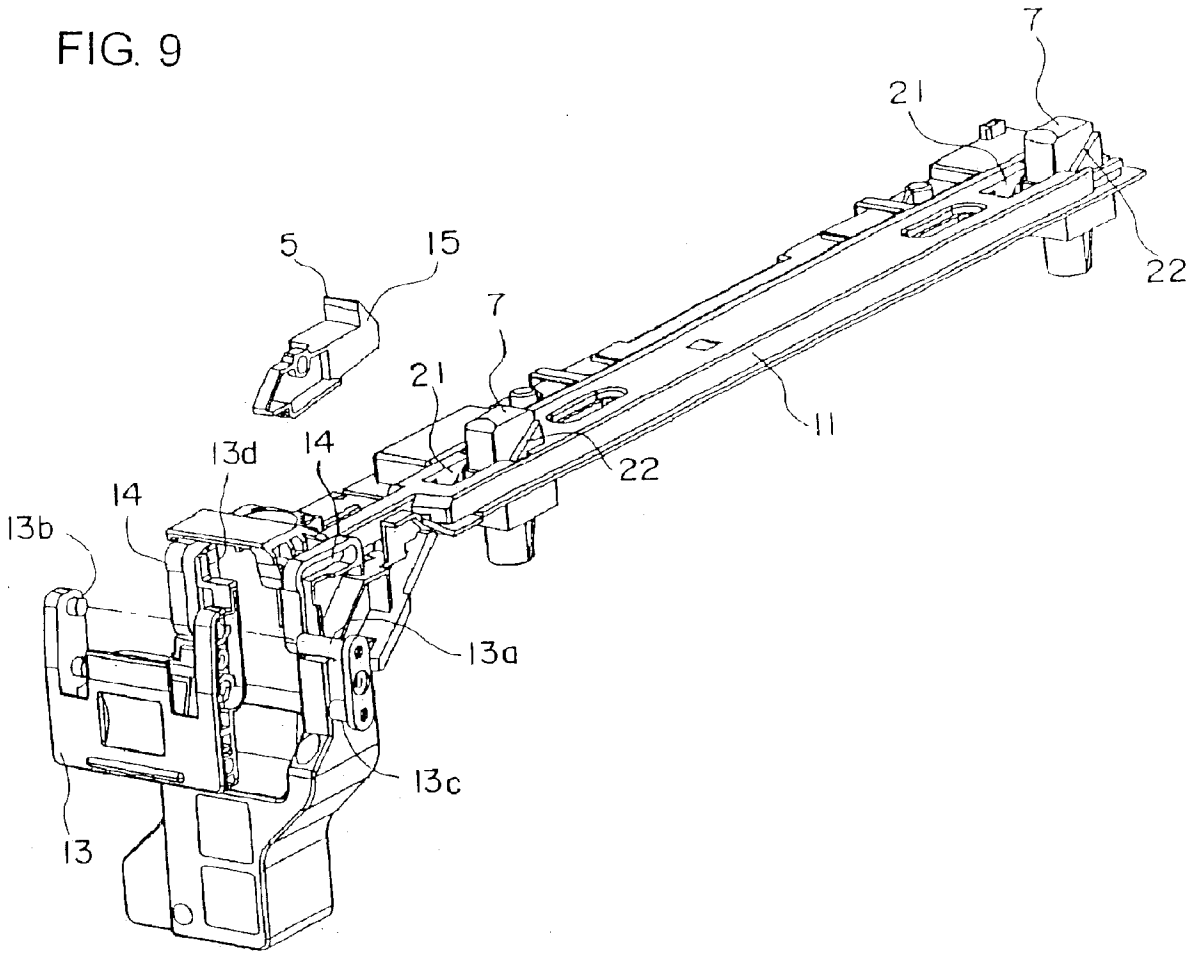
FIG. 9 is a perspective view showing the actual example of disassembled components constituting the actual example of the attachment structure for the top plate of the toner cartridge of the invention.

The actuating rod 11 is a rod-shaped resin mold member disposed on the top plate of the toner cartridge 3 and capable of sliding in the longitudinal direction, having a pin 12 protruding sideways from one longitudinal end thereof, the tip of the pin 12 movably fit to one side of the L-shaped guide groove 14 and further engaged to a pin 13*a* disposed to a side end portion of one leg of the release lever 13 (refer to FIG. 9).

The pin 12 slides along the inner surface of the L-shaped guide groove 14 when the actuating rod 11 slides.

The release lever 13 is composed of a somewhat E-shaped resin molded member, with one pair of leg portions disposed on both sides thereof (refer to FIG. 9), and one end of one leg portion comprises a pin 13*a* that is rotatably connected to the pin 12 of the actuating rod 11 in a state sandwiching one side of the L-shaped guide groove 14, and the other leg comprises a pin 13*b* opposed to and disposed coaxially with the pin 13*a* which is fit to the other side of the L-shaped guide groove 14. Thereby, the release lever 13 is fit freely to the guide groove 14 via one pair of pins 13*a*, 13*b* provided to the leg portions thereof.

The side surface of a release lever 13 further comprises a pin 13*c* that is parallel to the pin 13*a* axis and separated by a center distance, the pin 13*c* also fit freely to the L-shaped guide groove 14. The center distance between the pins 13*a* and 13*c* is substantially equal to the length of one leg of the L-shaped guide groove 14 (refer to FIG. 9).

Figure 1:
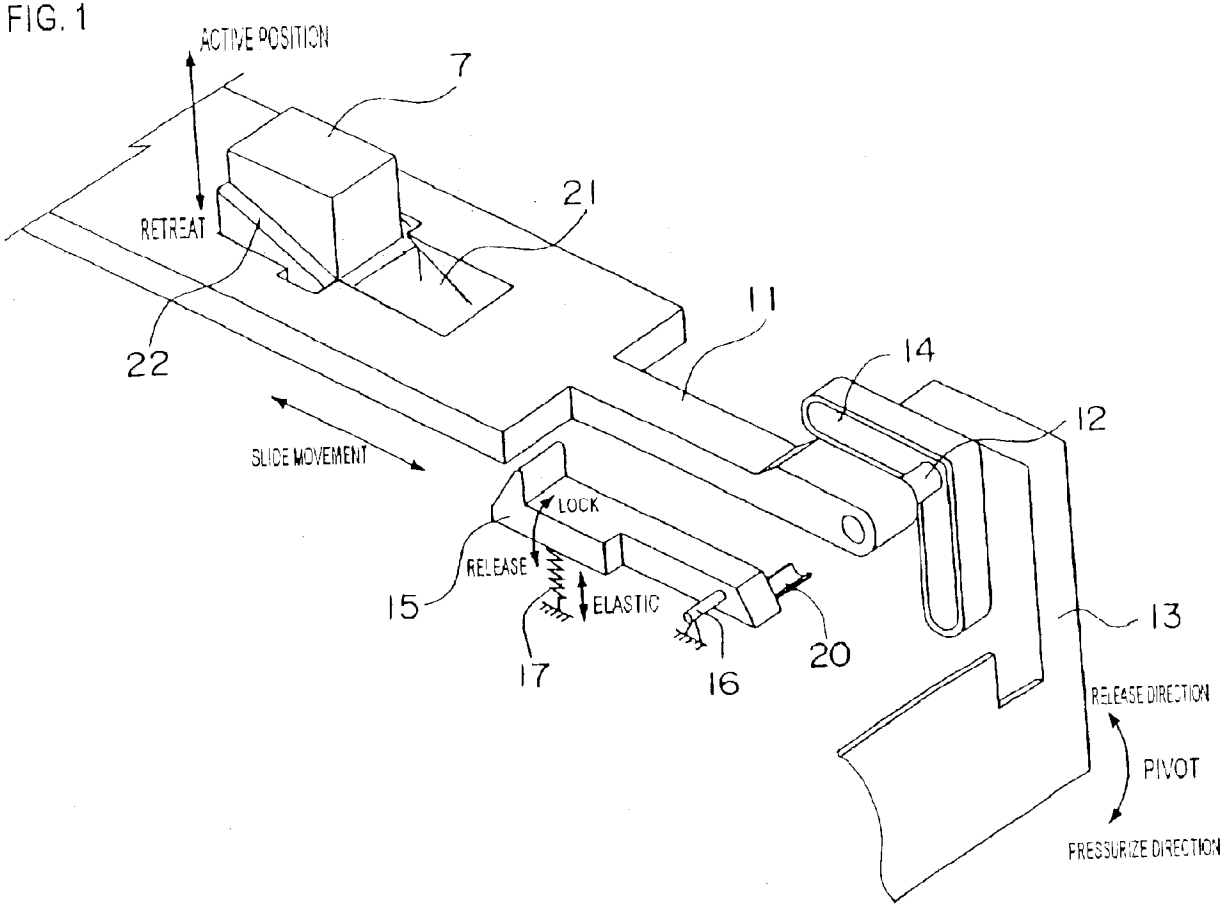
FIG. 1 is a simplified perspective view showing the main portion of the mechanism disposed on a top plate of a toner cartridge according to the present invention.

According to this construction, when the release lever 13 is moved downward (in the pressurizing direction) in FIG. 1, the pins 12, 13*a* and 13*b* on the release lever slide to the corner portion of the L-shaped guide groove 14, and the pin 13*c* moves to the lower end of the L-shaped guide groove 14.

When the release lever 13 is swung upward (in the release direction) in the horizontal direction, the pins 12, 13*a* and 13*b* on the lever slide to the upper end of the L-shaped guide groove 14, and the pin 13*c* is positioned at the corner of the L-shaped guide groove 14.

Accordingly, the distance of movement of pin 12 is equal to the length of the leg of the L-shaped guide groove 14.

As explained, the relationship between the direction of rotation of the release lever 13, the slide direction of the actuating rod 11 and the contact and separation motion of the developing roller 2 and photosensitive drum 4 are set so that when the lever 13 is rotated downward (pressurizing direction), the actuating rod 11 slides toward the front (right side of FIG. 1) releasing the biasing force generating means 7 (bringing the means 7 to its operating state), and the developing roller 2 is pressed against the photosensitive drum 4.

When the release lever 13 is rotated to the upper direction (release direction), the actuating rod 11 slides toward the back (left side of FIG. 1), and the developing roller 2 is moved away from or retreated from the photosensitive drum 4.

In detail, the device is designed so that a plurality of openings 21 is formed on the actuating rod to correspond to the plurality of biasing force generating means 7 provided on the top plate of the toner cartridge 3, and when the upper side of the biasing force generating means 7 passes through the openings to protrude above the actuating rod, sloped portions 22 formed on both sides of each biasing force generating means 7 (that are in parallel relationship with the slide direction of the actuating rod 11) slide against and engage with the inner side width (that may be formed as a sloped surface) of the opening portion 21 formed to the actuating rod 11.

When the actuating rod 11 is slid to the right end direction as shown in FIG. 1, the engagement between the sloped portion22 and a portion of the inner width of the actuating rod opening 21 is released and the biasing force generating means 7 is put in a released state, according to which the coil spring installed in the biasing force generating means 7 is extended, bringing the biasing force generating means 7 to come into contact with the fixing portion of the image forming device (refer to FIGS. 3(*a*), 8 and 9).

As explained, when the biasing force generating means 7 is put in a released state, the spring force rotates the developer casing 1 around the fulcrum axis 8, and brings the developing roller 2 to come into contact with appropriate pressure to the photosensitive drum 4 (refer to FIG. 3(*a*)).

Each opening 21 formed to the actuating rod 11 has a predetermined length along the sliding direction of the actuating rod 11 (substantially equal to the stroke length, one leg of the L-shaped guide groove), and so the biasing force generating means 7 disposed on the toner cartridge 3 will not restrict the slide movement of the actuating rod 11.

Next, when the release lever 13 is pivoted to the direction for releasing the pressured state, the actuating rod 11 slides in the left direction in FIG. 1, bringing the sloped portions 22 of the biasing force generating means 7 to be engaged with and to slide against a portion of the width side surfaces of the opening 21. The sliding movement displaces the biasing force generating means 7 downward, and the biasing force generating means 7 is brought to a restrained state. In other words, the elastic (spring) force of the biasing force generating means 7 is brought to a non-active state. When the rotation moment provided to the developer casing is thus removed and the pressurized state between the developing roller 2 and photosensitive drum 4 is released, the surfaces of the roller 2 and the drum 4 are preferably separated (if necessary, a slight spring pressure can be utilized).

When the toner cartridge 3 is being mounted on or removed from the developer casing 1, or when the developer casing storing the toner cartridge 3 is being mounted on or removed from the image forming device 10 (process casing 5), it is necessary that the elastic (spring) force of the biasing force generating means 7 in the toner cartridge 3 must be in a non-active state.

A lock member 15 is a resin mold component having one end supported by a support portion 16 provided to the top plate of the toner cartridge 3, and the other end formed as a hook biased toward the upper direction (lock direction) via a spring 17, the spring-supported end capable of being pivoted freely about the support axis 16 as fulcrum.

After mounting the toner cartridge 3 to the image forming device 10 (developer casing 1) or mounting the developer casing 1 storing the toner cartridge 3 to the image forming device, and when the release lever 13 is rotated in the pressurizing direction, the tip of the hook on the lock member 15 engages with the fixing portion on the front end of the body of the image forming device 10 (for example, the back surface of the front side frame of the image forming device) so as to maintain the fixture of the assembly of the unit.

Simultaneously, since the actuating rod moves to release the biasing force generating means 7 and the elastic (spring) force reaches the fixed portion, the developer casing 1 pivots and presses the developing roller 2 onto the photosensitive drum 4.

The lock member 15 is provided with an integrally formed regulation block 20 that protrudes from the lock member in the direction orthogonal to the longitudinal direction of the member 15.

After inserting the developer casing 1 (toner cartridge 3) to the image forming device 10, the release lever 13 is rotated in the predetermined direction to slide the actuating rod 11 so as to release the biasing force generating means 7, and to thereby pressurize the developing roller 2 to the photosensitive drum 4 of the process casing 5. By this movement, the regulation block 20 of the lock member comes into engagement with (or interferes with) the slid position of the actuating rod 11. Therefore, even if the hooked end of the lock member 15 is attempted to be displaced downward, the disposition of the member 15 is restricted (refer to FIG. 5*a*) and the locked state or engaged state cannot be released.

Thus, the locked state of the lock member 15 at the hooked end cannot be released until the release lever 13 is moved in the direction releasing the pressure so that the developing roller 2 (developer casing) is separated from the photosensitive drum 4.

Figure 7:
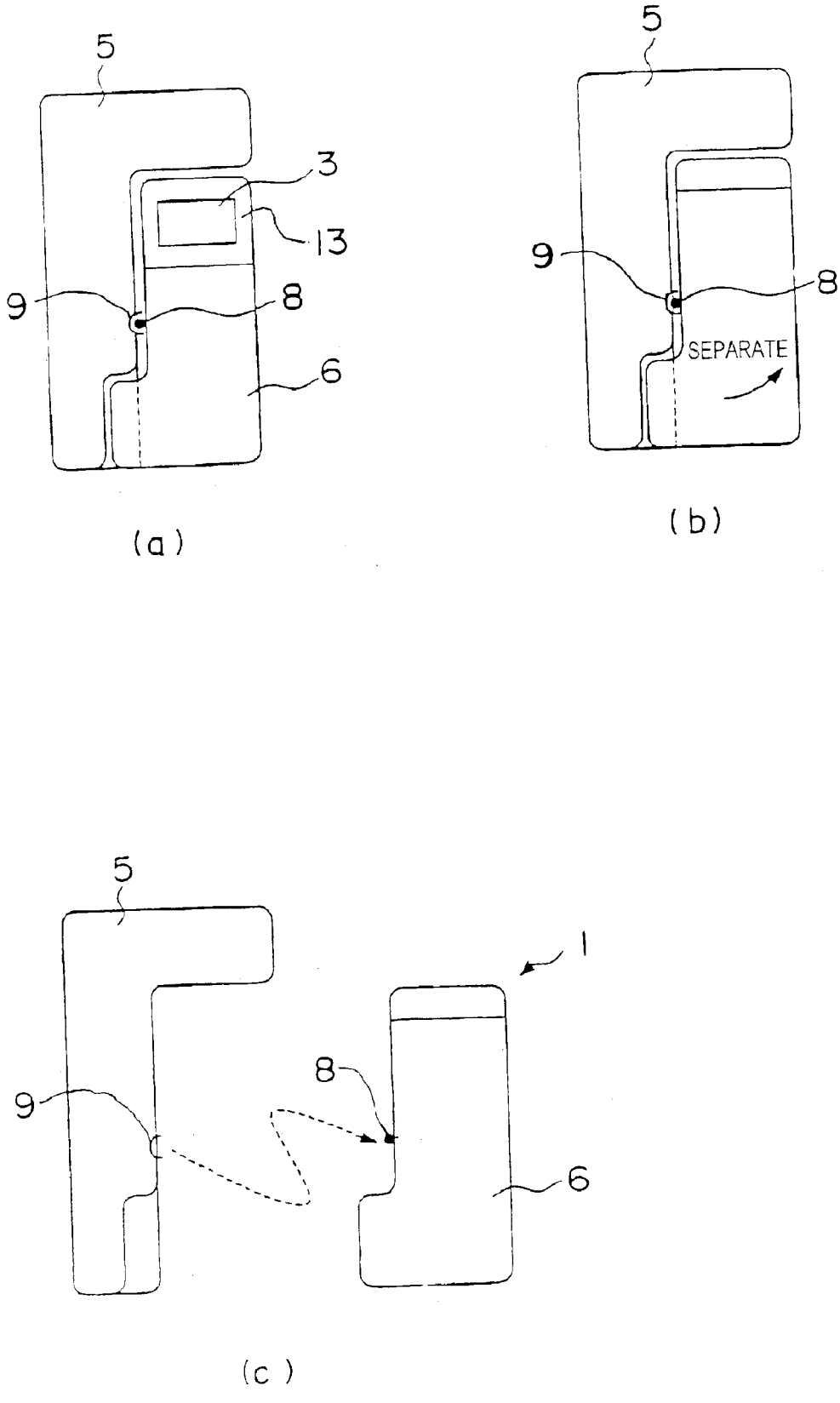
FIG. 7 shows the steps for removing the developer casing containing the toner cartridge from the image forming device of the invention.

When the actuating rod 11 moves in the left direction of FIG. 1 along with the movement of the release lever 13 to the releasing direction, the interference or engagement of the release lever 13 (the bottom surface of the lever) and the regulation block 20 of the lock member 15 is cancelled, enabling the lock member 15 to pivot about the supporting axis 16. Furthermore, a protruding end piece 13*d* (refer to FIG. 9) on one end of the release lever 13 as shown in FIG. 7 moves and engages with the lower surface of the regulation block 20 of the lock member 15, pushing the same upward. Thereby, the hook on the opposite end of the lock member 15 is displaced around the supporting axis 16 in the direction releasing the lock, thereby releasing the locked state of the developer casing 1 or toner cartridge 3 to the image forming device 10 (refer to FIG. 5*b*).

This shows that unless the release lever 13 is pivoted in the direction releasing the pressurized state, the developer casing 1 (or toner cartridge 3) mounted on the image forming device 10 cannot be replaced.

From the above, when inserting the toner cartridge 3 to the attachment guide frame 6 equipped to the developer casing 1 and when inserting the developer casing storing the toner cartridge 3 to the image forming device 10 (process casing 5) or replacing the same, the release lever 13 provided to the toner cartridge 3 must be maintained at the upper (release) position. In other words, when handling the toner cartridge 3 itself or the developer casing 1 storing the toner cartridge 3, it is necessary to seal the elastic (spring) force of the biasing force generating means 7 disposed on the top plate of the toner cartridge 3 by the actuating rod 11, that is, to place the release lever 13 to its released position.

The release lever 13 is pivoted to the pressurizing direction only after the developer casing 1 is completely inserted to the image forming device 10 (process casing 5). As a result, the elastic (spring) force of the biasing force generating means 7 of the toner cartridge 3 is released so as to appropriately press the developing roller 2 onto the photosensitive drum 4, and other various effects mentioned above are also achieved.

As explained, according to the image forming device 10 thus constructed, the displacement of the hook end of the lock member 15 is restricted during mounting of the developer casing 1 or toner cartridge 3, so as to enhance the safety and reliability of the toner cartridge 3 against accidents such as dropping of the unit during exchange or vibration of the device during operation.

In order to facilitate explanation of the present invention, the image forming device shown in FIGS. 2 and 3 are simplified, omitting parts such as the release lever for moving the biasing force generating means 7 or the lever for locking the process casing 5 to or releasing the same from the image forming device 10.

Next, we will explain the overall operation procedure of the image forming device 10 according to the embodiment of the present invention.

[Flow of Operation for Mounting and Removing Developer Casing]

Figure 6:
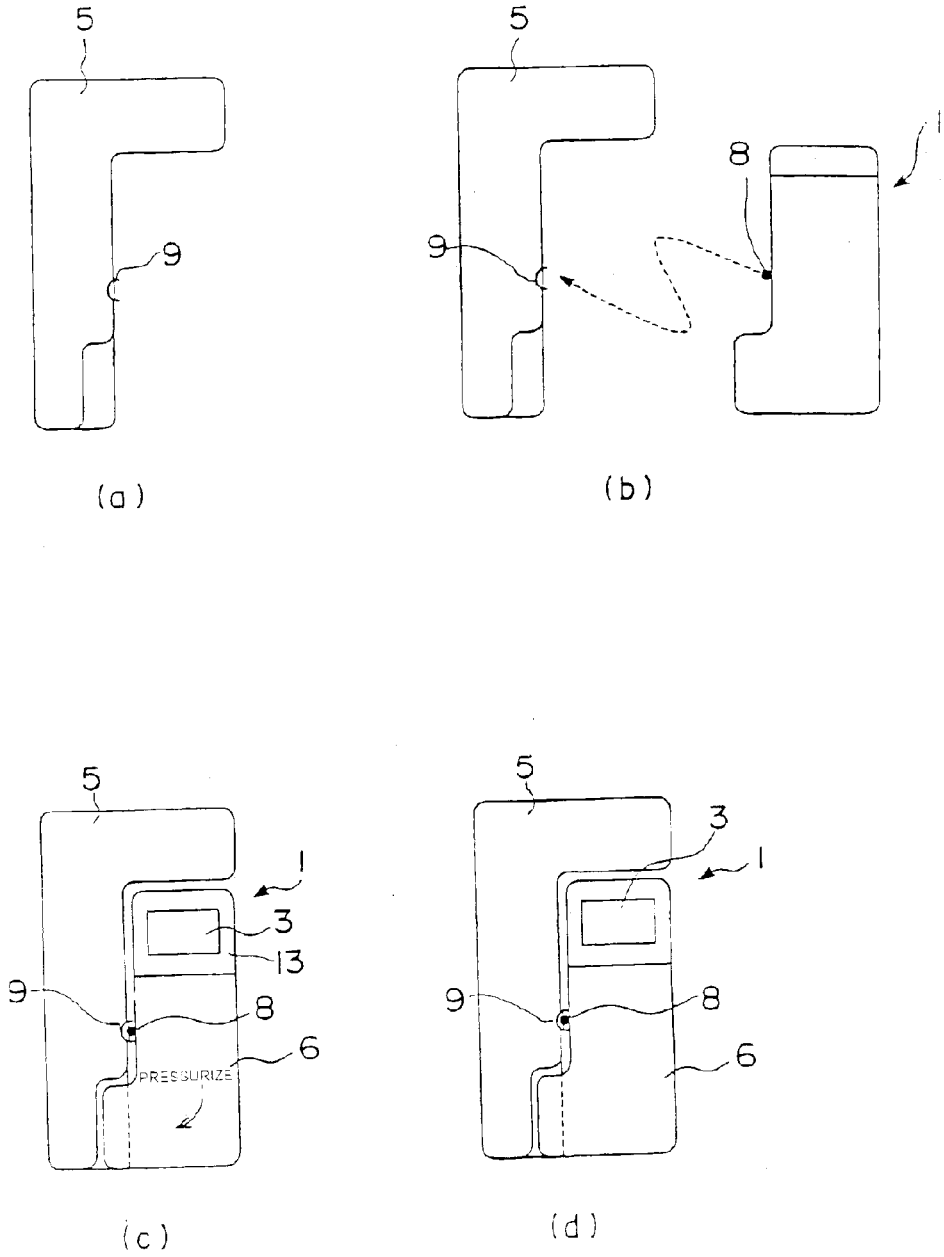
FIG. 6 shows the steps for mounting a developer casing containing a toner cartridge onto the image forming device of the present invention.

(Refer to FIG. 6 for Mounting Operation)

(1) Mounting of Process Casing

As shown in FIG. 6(*a*), when the process casing 5 is mounted in advance to the image forming device body, an axis guide 9 (having either a C- or U-shaped cross section) for the developer casing 1 is disposed in the image forming device. The axis guide formed on the side surface or bent lower surface of the wall of the process casing that opposes the developer casing provides a fitting guide rail for guiding the fulcrum axis 8 provided to the developer casing 1 along its longitudinal direction and to position the developing roller appropriately against the photosensitive drum when the developer casing 1 is inserted from the front side of the image forming device.

(2) Mounting of Developer Casing

Next, as shown in FIG. 6(*b*), the developer casing 1 is mounted to the process casing 5 (image forming device). The toner cartridge is integrally stored in the developer casing 1 (corresponding to CRU mode), and since the release lever of the cartridge is not pivoted (the release lever is positioned horizontally or in release position), so the biasing force generating means is placed at a non-active position by the actuating rod.

Though not shown, in this state, the back end portion of the fulcrum axis 8 on the developer casing 1 is inserted from the front end to the groove of the axis guide 9 provided to the process casing 5 from the front side of the image forming device, and pushed in along the groove.

The developer casing 1 is inserted to and positioned in the image forming device by being pushed in along the process casing 5 to a predetermined position in the depth (longitudinal) direction of the casing.

Since the release lever on the developer casing 1 is not moved from its release position, the biasing force generating means will not press against the process casing 5, and the developing roller is not pressed against the photosensitive drum with appropriate pressure.

(3) Pressurizing Operation

As shown in FIG. 6(*c*), the developer casing 1 storing the toner cartridge 3 is pushed in along the process casing 5 (image forming device) until it reaches a predetermined position, and thereby, the developer casing 1 or developing roller can be positioned with high accuracy with respect to the photosensitive drum.

It is preferable to set the center of gravity of the developer casing 1 so that the portion above the fulcrum axis 8 of the casing 1 is tilted somewhat toward the process casing 5 while the portion below the fulcrum axis 8 is separated from the process casing 5.

The same result can be achieved by utilizing a slight spring force.

Next, the release lever 13 on the developer casing 1 is pivoted downward (pressurizing direction), along with which the interlocked actuating rod releases the biasing force generating means being in a non-active state so that it pushes against the process casing 5 (image forming device). By the reaction force of the spring, a rotation moment is provided pivoting the developer casing 1 clockwise about the fulcrum axis 8, according to which the developing roller is pressed with appropriate force (the contact pressure being even and stable throughout the generatrix) against the surface of the photosensitive drum 4. The position, number, spring force etc. of the biasing force generating means is determined so that the developing roller is pressed appropriately against the surface of the drum 4.

During this period, the lock member automatically operates to fix the developer casing 1 to the image forming device.

(4) Complete Mounting Operation

By the interlocked movement of the actuating rod, the position of the rod prevents the lock member from releasing its locked state, thereby protecting the device against malfunction. Therefore, even if there is any external cause of malfunction, as long as the image forming device is in a normal operation state, the operation will not be influenced.

Thus, as shown in FIG. 6(*b*), the mounting of the developer casing 1 to the image forming device (process casing 5) is completed.

(Removal Operation, Refer to FIG. 7)

Upon removing the developer casing 1 and the process casing 5 from the image forming device 10, the operator follows the opposite procedure as the procedure explained above.

(1) Release Pressurized State

As shown in FIG. 7(*a*), by rotating the release lever 13 upward (in the release direction), the actuating rod is moved, separating the spring of the biasing force generating means provided to the toner cartridge 3 away from the fixing surface of the image forming device. Thereby, the pressurized state between the developing roller and the photosensitive drum assembled to the process casing 5 is released.

Further, by the slide movement of the actuating rod, the portion preventing release of the engaged state of the lock member is moved, and the protruding piece on one leg of the release lever 13 comes into contact with the regulation block, thereby releasing the engaged state of the lock member.

(2) Disengage Developing Roller

Thereby, as shown in FIG. 7(*b*), the developer casing 1 swings by its own weight to the counterclockwise direction about the fulcrum axis 8 (the center of gravity of the developing roller 1 is positioned on the opposite side from the process casing 5 with respect to the fulcrum axis 8). As a result, the developing roller retrieves and separates from the circumferential surface of the photosensitive drum assembled to the process casing 5, and is positioned at a safe place.

(3) Disengage Developer Casing

As shown in FIG. 7(*c*), while maintaining the developing roller at a retrieved/separated state from the photosensitive drum, the fulcrum axis 8 (developer casing 1) is pulled out longitudinally from the axis guide of the image forming device (process casing 5).

Since the engagement of the lock member is released, the lock will not prevent developer casing 1 from being pulled out for replacement.

The developer casing 1 can be removed from the process casing 5 (image forming device body) with the developing roller safely retrieved/separated from the photosensitive drum surface.

EXAMPLES

We will now explain a few examples of the toner cartridge 3 and the image forming device equipped with the toner cartridge 3 according to the present invention.

Figure 8:
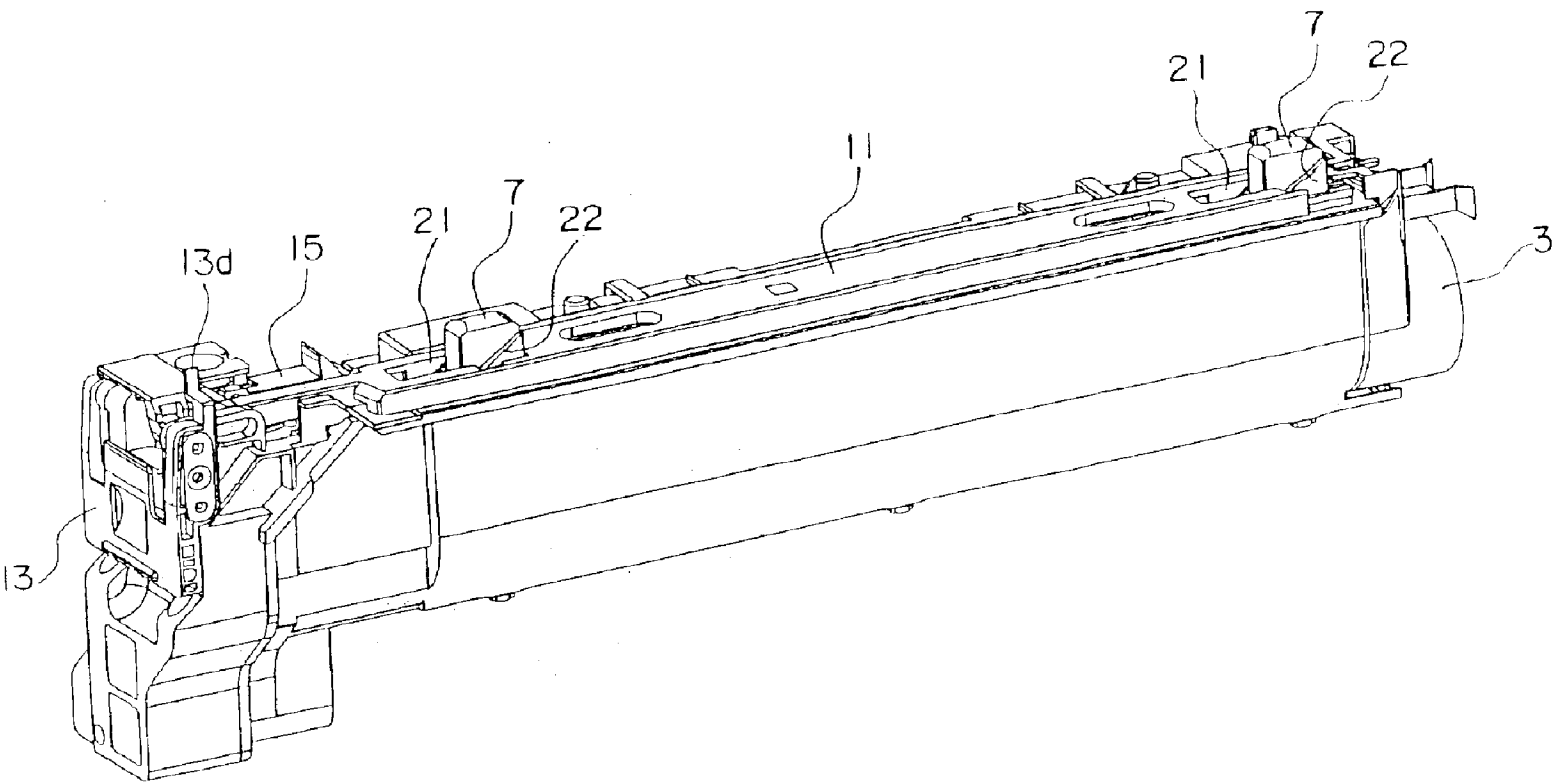
FIG. 8 is a perspective view showing the actual example of the toner cartridge of the invention.

FIG. 8 is a perspective view of the toner cartridge 3, and in the drawing, the same reference numbers that appeared in the previous description refer to the components having the same name, structure and assembly (the same can be said for the following explanations).

In the drawing, the release lever 13 takes its pressurizing position (vertical direction), along with which the biasing force generating means 7 is released and the lock member 15 operated, but this is merely illustrated for explaining the combination of the components of the toner cartridge 3, and is not the ordinary state.

If the toner cartridge 3 is taken out alone, the release lever 13 is at a released position (horizontal direction), and the other related components take their positions accordingly, as shown in FIG. 10.

FIG. 9 is a perspective view showing the state in which the frame portion of toner cartridge 3 shown in FIG. 8 is eliminated, and the relation between the members disposed on the top plate is mainly illustrated in disassembled state.

Similar to FIG. 8, this drawing does not illustrate the ordinary state of the toner cartridge 3.

FIG. 10 illustrates the state of the developer casing 1 before being mounted to the image forming device. It is a perspective view opposite that of FIG. 9.

The detailed construction of the fulcrum axis 8 of the developer casing 1 is illustrated in FIG. 10. Further, a portion of the circumferential surface of developing roller 2 is exposed longitudinally from the lower area of the casing.

In this state, the release lever 13 is not rotated, so the biasing force generating means is at its non-active position and is not released.

The process casing is mounted in advance to the image forming device. Thereafter, the end of the fulcrum axis 8 of the developer casing 1 is inserted from the front side of the device to the axis guide having a C-shaped or U-shaped cross section disposed to the process casing. Thereby, the developer casing 1 can be guided smoothly and reliably to the inside of the image forming device by the axis guide. After completing the insertion of the developer casing 1, the release lever 13 is pivoted downward, by which movement the biasing force generating means 7 is protruded through the opening 21 of the actuating rod 11 as shown in FIGS. 8 and 9 coming into contact with the fixed portion of the image forming device, thereby pivoting the developer casing 1 about the fulcrum axis 8 and pressing the develop roller 2 onto the photosensitive drum of the process casing.

Figure 11:
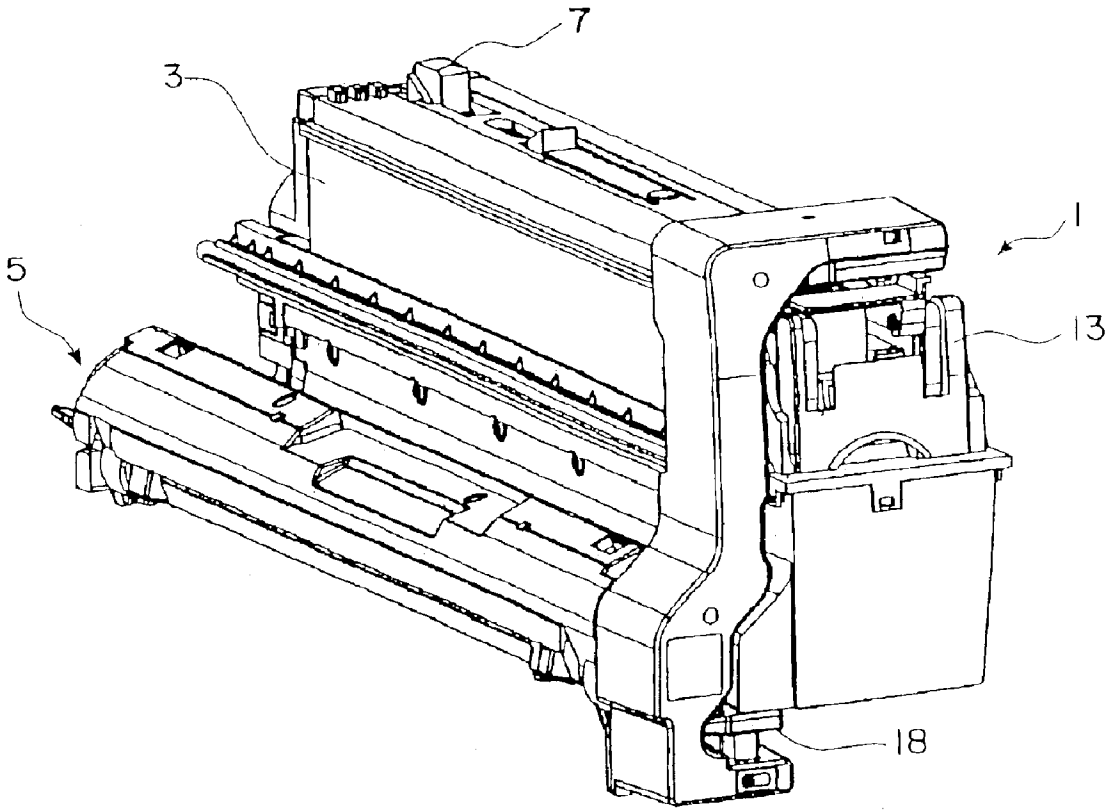
FIG. 11 is a perspective view showing the actual example of the image forming device according to the invention.

According to the above construction, when the developer casing 1 storing the toner cartridge 3 is mounted to the process casing 5 normally, it is assembled as shown in FIG. 11.

FIG. 11 is a perspective view similar to FIG. 10 illustrating the whole associated structure of the process casing 5 and the developer casing 1 attached by insertion to the process casing 5. The process casing 5 is mounted in advance to the image forming device.

Reference number 18 is a lever for releasing the fixture of the process casing to the image forming device 10 when removing the process casing 5 from the device 10 by pressing the lever downward, but there is no need to operate the lever when mounting the casing 5.

According to the present embodiment, the biasing force generating means is disposed on the top plate of the toner cartridge, but the means can be provided to other areas to achieve the same effect, such as other sides of the toner cartridge 3 (for example, on the side wall opposite to the side facing the photosensitive drum).

Further, the number of biasing force generating means 7 being disposed is not limited to two as illustrated in the present embodiment. For example, even if the biasing force generating means 7 is provided to only one area, the same effect can be achieved if the mounting position is determined appropriately.

In short, it is important that the arrangement and action of the biasing force generating means is determined so as to maintain an even and stable pressure along the generatrix between the photosensitive drum and the developing roller.

Moreover, according to the preferred embodiment, the biasing force generating means is described as being equipped with a compression coil spring, but it can comprise other means that generate reaction force against contract force.

As explained, the toner cartridge and the image forming device comprising the same according to the present invention characterizes in the following.

(1) By mounting a developer casing containing a toner cartridge on the image forming device, the biasing force generating means provides appropriate pressurizing force to press the developing roller against the photosensitive drum, so that a support guide unit (plate) for the developer casing and various members (operation member, link mechanism etc.) for providing pressurizing force to the developer casing that were equipped in the prior art image forming device are no longer required according to the present invention. Thus, the inner structure of the image forming device can be simplified.

Further, the pressure is provided efficiently using a biasing force generating means provided on the upper face of a toner cartridge having a rigid casing structure, the developing roller and the photosensitive drum can be pressed evenly and reliably throughout the whole length, reducing the dispersion of pressurizing force in the longitudinal direction.

Thus, stable image forming is made possible.

Moreover, the fixing and releasing of the developer casing against the image forming device body is made possible by a single operation of one manipulation member, so the procedure for mounting or removing the developer casing (toner cartridge) is simplified greatly, preventing damage or breakage of the device caused by erroneous manipulation (mistake in operation procedure), and improving the operability and safety of the device.

When the developer casing storing the toner cartridge is mounted to the image forming device, a lock mechanism is made to function simultaneously as when pressing the developing roller against the photosensitive drum, thereby creating a fixed state of the developer casing to the image forming device body.

Since this fixed state is maintained by the interference or engagement between the regulation block provided on the lock member and the actuating rod, unless this fixed state is released, the developer casing cannot be pulled out of the image forming device.

Thus, the construction prevents damage or drop of the photosensitive body during mounting or removal operation of the developer casing (toner cartridge) during operation.

(2) The switching between the active and non-active state of the biasing force generating means for pressing the developing roller onto the photosensitive drum and separating the roller therefrom is realized substantially simultaneously as the switching between the fixed and released state of the developer casing to the image forming device body, by a single operation using a single manipulation member (release lever). Therefore, the procedure related to the attachment and removal of the developer casing (toner cartridge) is simplified greatly.

(3) By utilizing coil springs as the biasing force generating means provided to plural areas of the casing, the pressurizing force for pressing with even pressure the developing roller 2 to the photosensitive drum 4 is obtained with a very simple structure, and problems such as an offset phenomenon that may be caused between the photosensitive drum and the developing roller (the imbalance of the pressurizing force along the generatrix) is prevented. When offset occurs between the developing roller and the photosensitive drum, the side having less pressure causes lack of image density or defective image. At worst, one axial side of the developing roller may not come into contact with the photosensitive drum at all.

(4) With a simple construction, the present invention provides a uniform pressure pressing the developing roller onto the photosensitive drum, making it possible for the device to perform stable image forming, to prevent damage caused by erroneous manipulation of the device unit, and to enhance operability and safety.

As explained, the present invention provides an image forming device that achieves various advantageous effects that could not have been achieved by the prior art image forming device.

What is claimed is:

1. A toner cartridge removably mounted on a developer casing storing a developing roller for developing an electrostatic latent image formed on a circumferential surface of a photosensitive drum by pressing against the photosensitive drum, the toner cartridge comprising:

a biasing force generating means disposed at plural areas of the cartridge and that presses against a fixed portion of an image forming device in elastic manner;

an actuating rod capable of switching said biasing force generating means between a released state and a non-active state;

a pivotable lock member for maintaining or releasing a lock corresponding to the movement of said actuating rod; and a manipulation member capable of sliding/pivoting motion causing said actuating rod and said lock member to be moved in predetermined manner, wherein said manipulation member, said actuating rod and said lock member are arranged so that they interconnect mutually; the sliding/pivoting motion of said manipulation member moving said actuating rod and further moving said lock member to engage or to release said lock, to thereby maintain or release fixture of and to simultaneously pivot or release pivot of said developer casing to said image forming device.

2. A toner cartridge according to claim 1, wherein a single pivoting operation of said manipulation member realizes both the movement of said actuating rod switching the biasing force generating means provided to plural portions of said toner cartridge that press against said fixed portion of an image forming device body in elastic manner between a released state and a non-activated state and the movement for fixing said developer casing to or releasing the same from the image forming device body.

3. A toner cartridge according to claim 1, wherein said biasing force generating means disposed at plural areas on the toner cartridge along a longitudinal direction are released in synchronism with the pivoting operation of said manipulation member, a reaction force of said biasing force generating means coming into contact with the fixed surface of said image forming device causing the developing roller of the developer casing to be pressed against the photosensitive drum.

4. An image forming device comprising the toner cartridge according to claim 1.

* * * * *